US009040826B2

(12) United States Patent
Oka et al.

(10) Patent No.: US 9,040,826 B2
(45) Date of Patent: May 26, 2015

(54) CABLE

(75) Inventors: Fumihito Oka, Hitachi (JP); Hirotaka Eshima, Hitachi (JP); Takafumi Kai, Hitachi (JP); Ryoji Mizutani, Nagoya (JP); Kenji Ishida, Nagoya (JP)

(73) Assignees: HITACHI METALS, LTD., Tokyo (JP); Toyota Jidosha Kabushiki Kaisha, Toyota-shi (JP)

( * ) Notice: Subject to any disclaimer, the term of this patent is extended or adjusted under 35 U.S.C. 154(b) by 517 days.

(21) Appl. No.: 12/760,096

(22) Filed: Apr. 14, 2010

(65) Prior Publication Data

US 2010/0270054 A1 Oct. 28, 2010

(30) Foreign Application Priority Data

Apr. 23, 2009 (JP) ..... 2009-105307

(51) Int. Cl.

| | |
|---|---|
| ***H01B 11/04*** | (2006.01) |
| ***H01B 5/10*** | (2006.01) |
| ***H01B 7/18*** | (2006.01) |
| *H01B 7/04* | (2006.01) |
| *H01B 7/22* | (2006.01) |

(52) U.S. Cl.

CPC *H01B 5/10* (2013.01); *H01B 7/041* (2013.01); *H01B 7/18* (2013.01); *H01B 7/228* (2013.01)

(58) Field of Classification Search

USPC ..... 174/107, 113 C, 128.1, 128.2; 385/101

See application file for complete search history.

(56) References Cited

U.S. PATENT DOCUMENTS

| | | | | | |
|---|---|---|---|---|---|
| 3,482,034 | A | * | 12/1969 | Rhoades et al. | 174/102 R |
| 3,829,603 | A | * | 8/1974 | Hansen et al. | 174/115 |
| 4,125,823 | A | * | 11/1978 | Hall, Jr. | 367/165 |
| 4,250,351 | A | * | 2/1981 | Bridges | 174/106 R |
| 4,449,012 | A | * | 5/1984 | Voser | 174/70 A |
| 4,600,268 | A | * | 7/1986 | Spicer | 385/103 |
| 4,683,349 | A | * | 7/1987 | Takebe | 174/69 |
| 4,743,712 | A | * | 5/1988 | Lee | 174/113 C |
| 4,820,796 | A | * | 4/1989 | Suzuki et al. | 528/292 |
| 5,122,622 | A | * | 6/1992 | Reuss et al. | 174/113 C |
| 5,159,157 | A | * | 10/1992 | Diegmann | 174/113 C |
| 5,677,974 | A | * | 10/1997 | Elms et al. | 385/101 |
| 6,469,251 | B1 | | 10/2002 | Dupuis | |
| 7,674,973 | B2 | * | 3/2010 | Cardas | 174/36 |
| 2008/0296040 | A1 | * | 12/2008 | Hui | 174/101.5 |

FOREIGN PATENT DOCUMENTS

| | | |
|---|---|---|
| CN | 1152784 | 6/1997 |
| CN | 1443355 | 9/2003 |
| JP | 2002-124137 | 4/2002 |
| JP | 2003229029 | 8/2003 |
| JP | 2006344575 | 12/2006 |
| JP | 2006351322 | 12/2006 |
| JP | 2007305479 | 11/2007 |
| JP | 2008091214 | 4/2008 |

* cited by examiner

*Primary Examiner* — Chau N Nguyen

(74) *Attorney, Agent, or Firm* — Brundidge & Stanger, P.C.

(57) ABSTRACT

A cable having a cable structure comprising a stranded wire formed by stranding a plurality of stranded conductors and an inclusion that is more deformable than the stranded conductors, wherein a plurality of stranded conductors are arranged on a circumference of the inclusion.

16 Claims, 5 Drawing Sheets

CABLE

The present application is based on Japanese Patent Application No. 2009-105307 filed on Apr. 23, 2009, the entire contents of which are incorporated herein by reference.

TECHNICAL FIELD

The present invention relates to a cable that is used in an environment where the cable receives repeated bending like robots or automobiles.

BACKGROUND ART

A cable that is used in an environment where the cable receives repeated bending like robots or automobiles (e.g., an unspring mass of an automobile) are required to have not only high bending durability but also high flexibility from the viewpoint of eased cabling. These two requirements, i.e. high bending durability and high flexibility, were however never achieved at the same time.

JP2002-124137A describes an art that prevents an overhead distribution line from sagging even if its stranded conductor breaks by providing therein a strength member having a tensile strength more than five times greater than that of its stranded conductor.

In JP2002-124137A, it is intended to prevent an overhead distribution line from sagging even if its stranded conductor breaks. In a cable that receives repeated bending however, it is preferable to prevent the stranded conductor from breaking. Further, it is also preferable to provide high flexibility as stated above at the same time.

SUMMARY OF INVENTION

The present invention provides a cable that solves the above-stated problems and, at the same time, realizes both high bending durability and high flexibility.

According to the first aspect of the present invention, a cable by the present invention is given such a configuration as has a cable structure comprising a stranded wire formed by stranding a plurality of stranded conductors and as has an inclusion that is more deformable than the stranded conductor, wherein the plurality of stranded conductors are arranged on a circumference of the inclusion.

According to the second aspect of the present invention, a cable by the present invention is given such a configuration as has a cable structure comprising a master stranded wire formed by stranding a plurality of slave stranded wires each of which is made up of a plurality of stranded conductors and as has an inclusion that is more deformable than the slave stranded wire, wherein the plurality of slave stranded wires are arranged on a circumference of the inclusion.

According to the third aspect of the present invention, the inclusion can be made of resin.

According to the fourth aspect of the present invention, the inclusion can be given a tube form.

According to the fifth aspect of the present invention, the inclusion can be a yarn made up of stranded plural fiber threads.

According to the sixth aspect of the present invention, the fiber thread can be a staple fiber thread.

According to the seventh aspect of the present invention, a periphery of the stranded conductors arranged on a circumference of the inclusion or a periphery of the slave stranded wires arranged on a circumference of the inclusion can be covered with an insulating layer composed of an electrical insulator, a circumference of said insulating layer can be covered with a shielding layer composed of a conductive material.

According to the eighth aspect of the present invention, a periphery of the shielding layer can be covered with a reinforced braid layer composed of a fiber, a circumference of said reinforced braid layer can be covered with a sheath composed of a resin.

According to the present invention an excellent effect can be exerted, i.e. the present invention can actualize both of high bending durability with high flexibility at the same time.

DESCRIPTION OF EMBODIMENTS

The following details embodiments of the present invention with reference to attached drawings.

Figure 1:
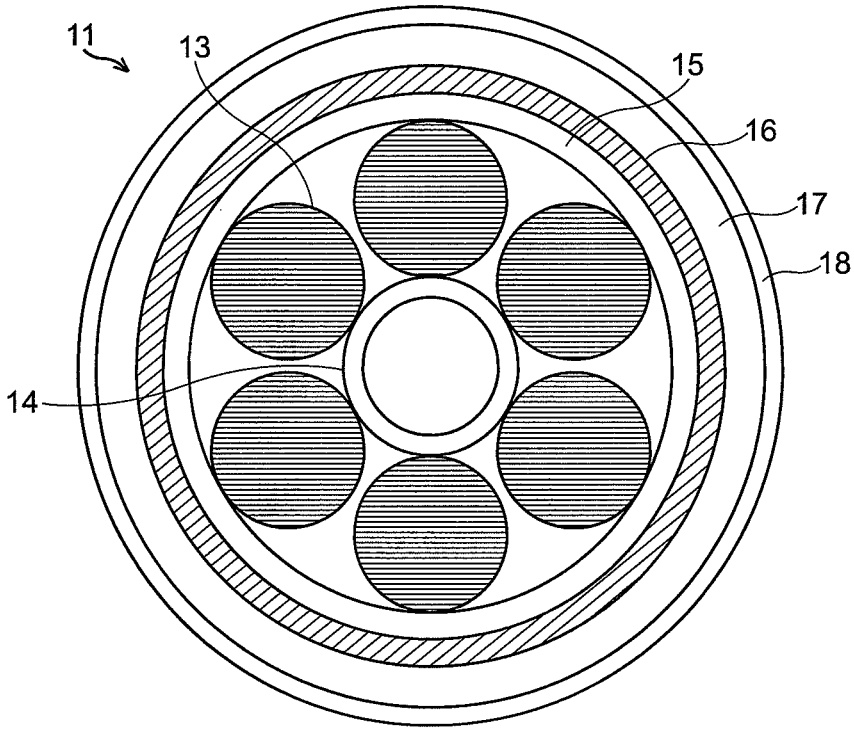
FIG. 1 illustrates a cross-sectional view of a cable to show a mode of implementing the present invention.

As FIG. 1 illustrates, a cable 11 according to one embodiment of the present invention has a cable structure comprising a stranded wire formed by stranding a plurality of stranded conductors 13 and an inclusion 14 that is more deformable than the stranded conductor 13, wherein the plurality of stranded conductors 13 are arranged on the circumference of the inclusion 14. Each of the plural stranded conductors 13 is a strand of plural conductor wires.

The plurality of stranded conductors 13 are disposed at an approximately equal interval on circumferential positions located at the predetermined distance from the structural center of the cable 11. The circumference of the plurality of stranded conductors 13 is covered with an insulating layer 15 composed of an electrical insulator. The circumference of the insulating layer 15 is covered with a shielding layer 16 composed of a conductive material. The circumference of the shielding layer 16 is covered with a reinforced braid layer 17 composed of a fiber. The circumference of the reinforced braid layer 17 is covered with a sheath 18 composed of a resin.

In the cable 11, the inclusion 14 is disposed at the approximate center of the annular formation created by the plurality of stranded conductors 13. The inclusion 14 has flexibility. Since the inclusion 14 has a more deformable nature than the stranded conductor 13, the outer periphery of the inclusion 14 deforms when a bending applied on the cable 11 causes the stranded conductor 13 to press the inclusion 14.

Figure 2:
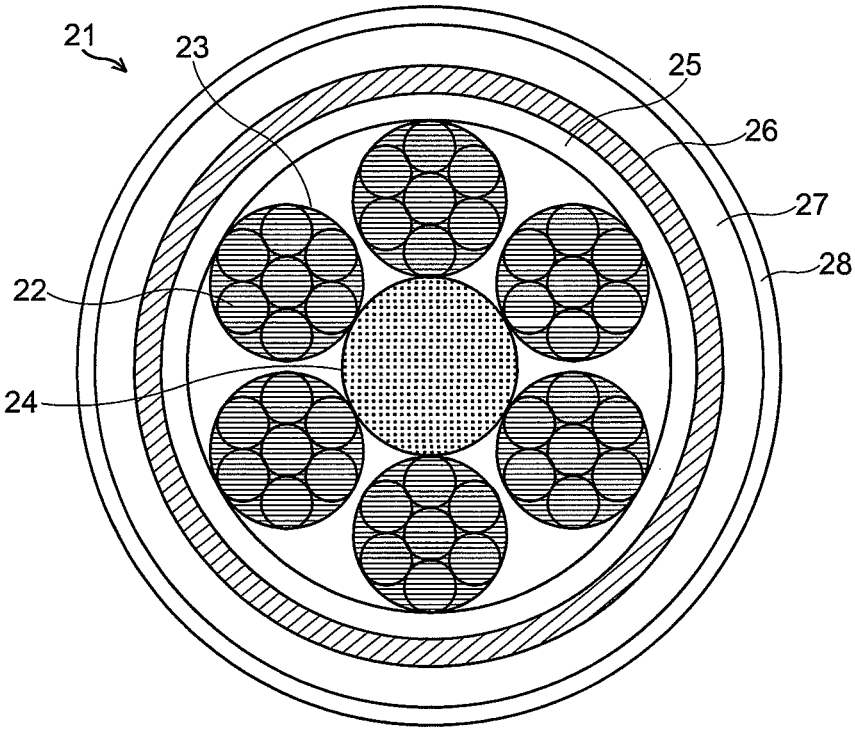
FIG. 2 illustrates a cross-sectional view of a cable to show a mode of implementing the present invention.

Further, as FIG. 2 shows, a cable 21 according to another embodiment of the present invention has a cable structure comprising a master stranded wire formed by stranding a plurality of slave stranded wires 23 each of which is a stranded wire of a plurality of stranded conductors 22 and an inclusion 24 that is more deformable than the slave stranded wire 23, wherein the plurality of slave stranded wires 23 are arranged on the circumference of the inclusion 24 (this arrangement is referred to as the cable structure comprising a master stranded wire). Each of the stranded conductors 22 is a strand of a plurality of conductor wires.

The plurality of slave stranded wires 23 are disposed at an approximately equal interval on circumferential positions located at the predetermined distance from the structural center of the cable 21. The circumference of the plurality of slave stranded wires 23 is covered with an insulating layer 25 composed of electrical insulator. The circumference of the insulating layer 25 is covered with a shielding layer 26 composed of a conductive material. The circumference of the shielding layer 26 is covered with a reinforced braid layer 27 composed of a fiber. The circumference of the reinforced braid layer 27 is covered with a sheath 28 composed of a resin.

In the cable 21, the inclusion 24 is disposed at the approximate center of the annular formation created by the plurality of slave stranded wires 23. The inclusion 24 has flexibility. Since the inclusion 24 has a more deformable nature than the slave stranded wire 23, the outer periphery of the inclusion 24 deforms when a bending applied on the cable 21 causes the slave stranded wire 23 to press the inclusion 24.

The operations and advantages of the cable 11 shown in FIG. 1 will be described hereunder.

Firstly, the present invention employs a stranded conductor that is a strand of plural conductor wires; employment of this configuration enhances the bending durability. Secondly, the present invention gives each of the stranded conductors no jacketing for an eased terminal treatment.

In general, an ordinary type cable that has a cable structure of a plurality of stranded conductors has the one stranded conductor also at the structural center thereof, which position corresponds to the place occupied by the inclusion 14 in the cable 11, as shown in FIG. 1. When such an ordinary type cable is bent, the bending produces the largest stress on the outer periphery of the stranded conductor placed at the structural center. The cable 11 according to the present invention has such a configuration that the stranded conductor to be placed at the structural center of such an ordinary type cable is substituted with the inclusion 14 that is more deformable than the stranded conductor 13.

The pressure produced among stranded conductors 13 when the cable 11 is bent is absorbed by the deformation of the inclusion 14. Thereby, the pressure produced among stranded conductors 13 is relaxed suppressing the break of conductor wire in the stranded conductor 13; that is, the occurrence of the break of conductor wire at the portion where the stranded conductor 13 contacts each other is suppressed. As a result, the cable 11 is given a high bending durability.

Further, the cable 11 has a lower bending stiffness than that of the cable of above-stated ordinary type since the inclusion 14 deforms when bent. This means that the cable 11 has a high flexibility. Therefore, the cable 11 is bendable in a radius that is smaller than a radius such that the ordinary cable can tolerate, offering an eased cabling.

The cable 11 can be offered with a high bending durability by providing: an insulating layer 15 on the circumference of a conductor layer made up of the plurality of stranded conductors 13 arranged and stranded over the circumference of the inclusion 14; a shielding layer 16 on the circumference of the insulating layer 15; and a sheath 18 on the circumference of the shielding layer 16.

Further to the above, the cable 11 can be offered with a high impact resistivity by providing the reinforced braid layer 17 made up of a braided impact absorptive fibers between the shielding layer 16 and the sheath 18. For the impact absorptive braid, at least one of fibers selected from the group consisting of: fiber of polyethylene terephthalate, fiber of polyvinyl alcohol, and fiber of polyethylene-2,6-naphthalate, will be suitable.

Explanation of the operations and advantages of the cable 21 shown in FIG. 2 is omitted because the cable provides equivalent advantages to those stated above.

The inclusions 14 and 24 can be made from resin. The inclusions 14 and 24 can be formed in a tube shape, that is, a shape that has a hollow. The cable 11 shown in FIG. 1 is a cable that uses a silicone tube composed of silicone resin as the inclusion 14.

The inclusions 14 and 24 can be a twisted yarn made up of a strand of plural fibrous thread. The cable 21 shown in FIG. 2 is a cable that uses a staple fiber thread (staple yarn) as the inclusion 24. Rayon, PET, nylon, etc. can be used as the material of staple yarn.

Cables were manufactured as Embodiment 1, Embodiment 2, and a comparative example.

Figure 3:
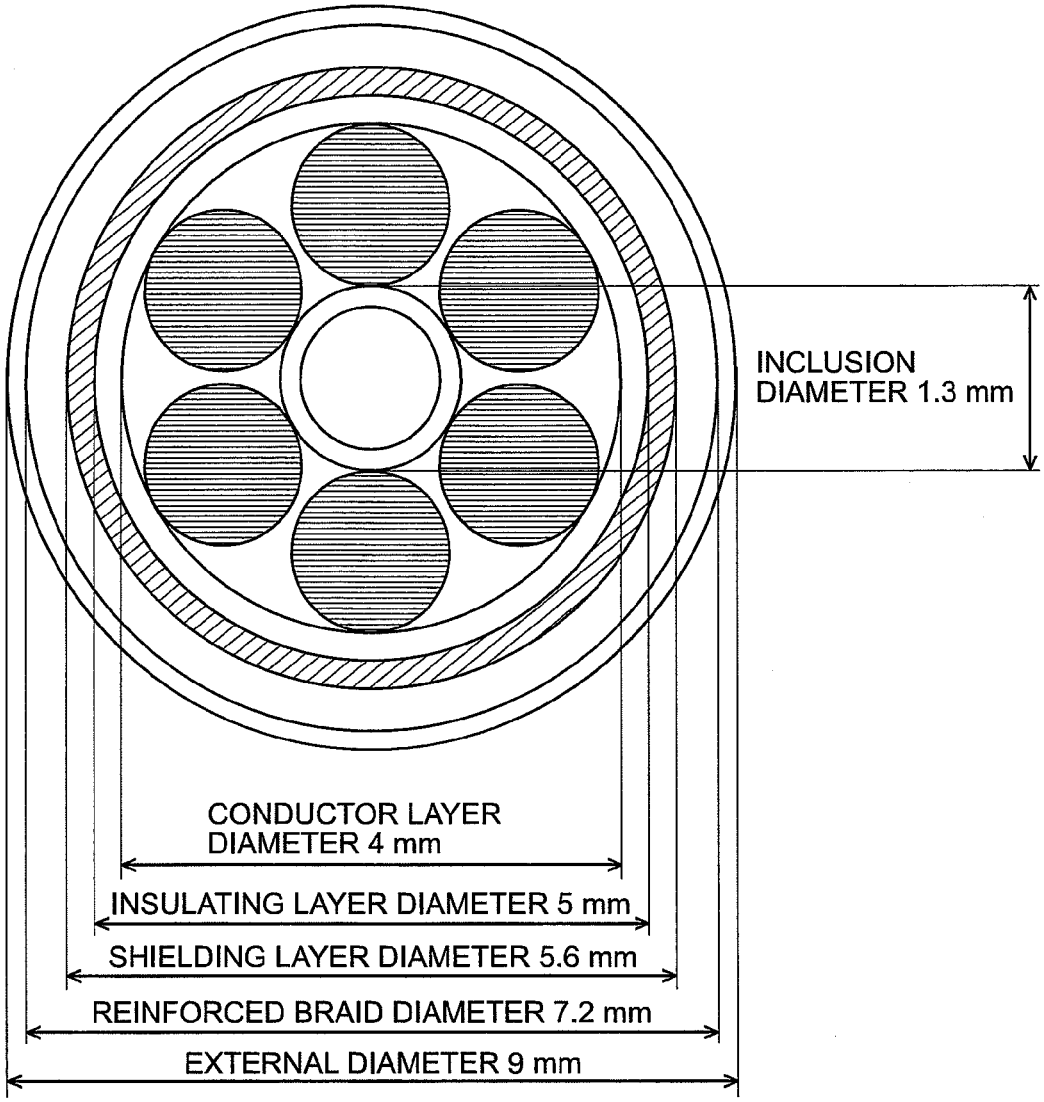
FIG. 3 illustrates a dimensional drawing of a cable in an embodiment.

Embodiment 1 is the cable 11 shown in FIG. 1, wherein six stranded conductors 13, each of which was made up of stranded plurality of conductor wires (soft annealed copper wires, i.e., tough pitch copper (TPC) wires), were arranged around the structural center of the cable. For the insulating layer 15, cross-linked polyethylene was used. For the shielding layer, tinned copper wire braid was used. For the reinforced braid layer 17, fiber of polyvinyl alcohol was used. Where preferred, fiber of polyethylene terephthalate, fiber of polyvinyl alcohol, or fiber of polyethylene-2,6-naphthalate, can be used for the reinforced braid layer. For the inclusion 14, a silicone tube made of silicone having a Shore (A) hardness of 45±5 was used. Each portion of the cable was dimensioned as FIG. 3 shows. The conductor layer is a layer made up of the stranded conductor 13.

Embodiment 2 is the cable 21 shown in FIG. 2, wherein a plurality of conductor wires (as stated above) were stranded to compose the stranded conductor 22 and six slave stranded wires 23, each of which was made up of a strand of a plurality of stranded conductors 22, were arranged around the structural center of the cable. For the inclusion 24, a staple fiber thread was used. Other layers were made up in the same configuration as in Embodiment 1.

Figure 4:
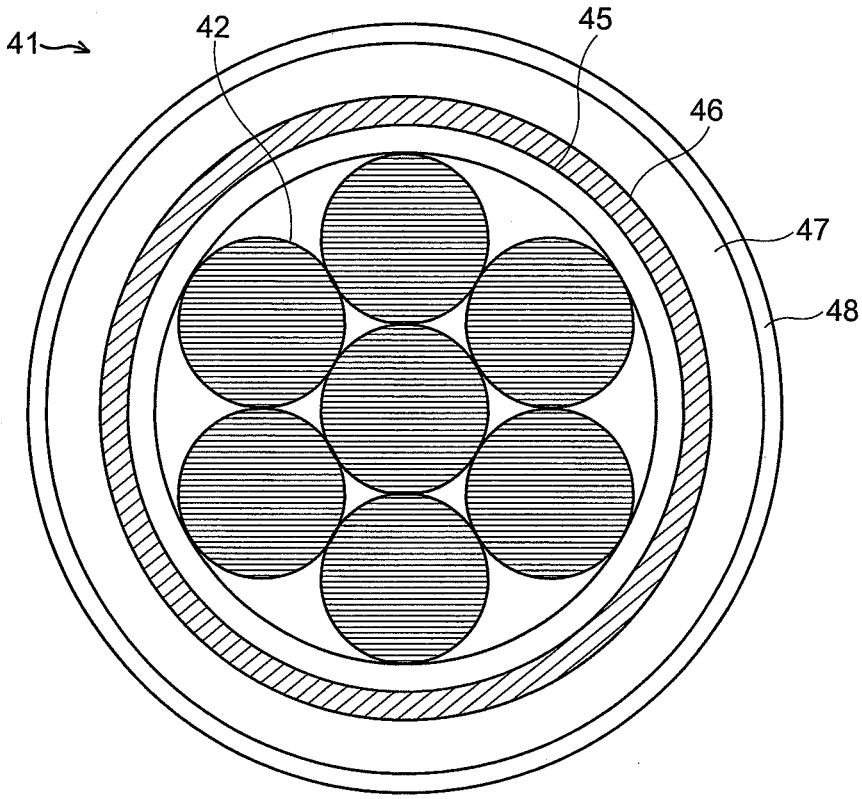
FIG. 4 illustrates a cross-sectional view of a cable of comparative example.

The cable of comparative example has no inclusion in its structure as FIG. 4 shows, wherein its structure is such that the inclusion 14 in the cable 11 shown in FIG. 1 is substituted with a stranded conductor. That is, a cable 41 of the comparative example was a cable comprised of seven-strand of a stranded conductor 42, each of which was made up of a strand of plural conductor wires (tinned copper alloy) and was provided with an insulating layer 45, a shielding layer 46, a reinforced braid layer 47, and a sheath 48 in this order over the circumference of the seven-strand in a manner similar to the cable 11 shown in FIG. 1.

These three cables: Embodiment 1, Embodiment 2, and the comparative example, underwent a bending durability test of 500,000 times of cyclic-bending in a 90° bend on R30, a radius of 30 mm. The results are shown in FIG. 5.

Figure 5:
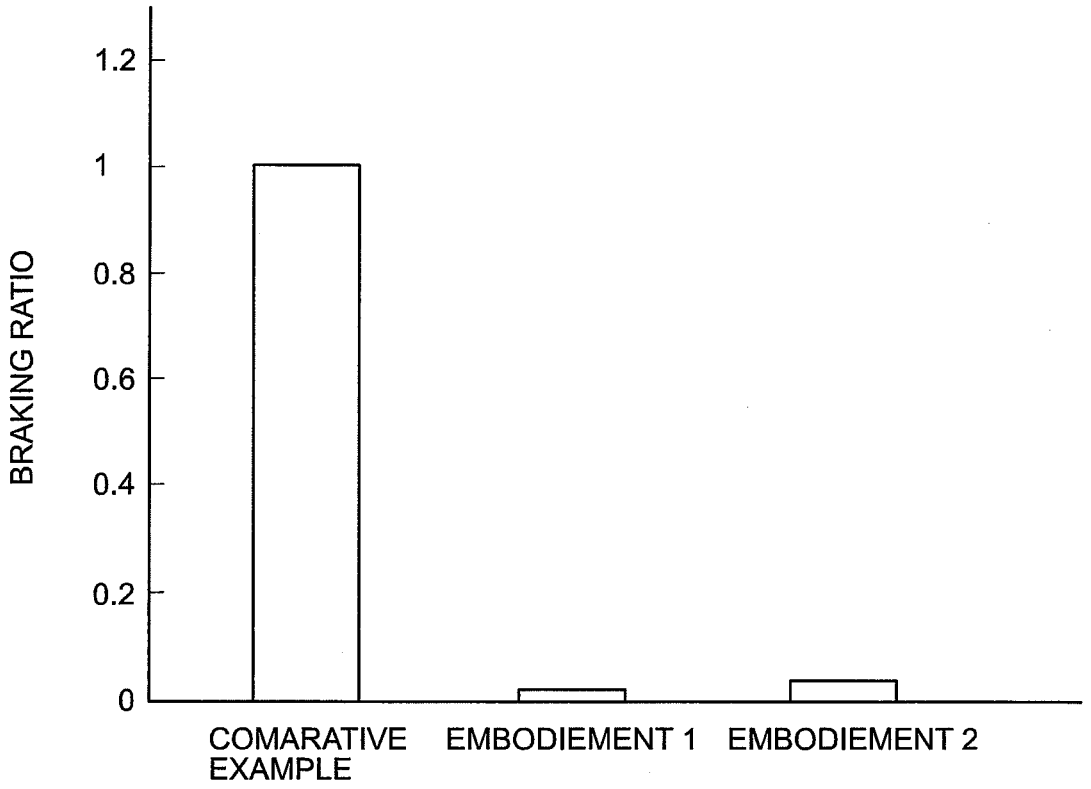
FIG. 5 illustrates a performance comparison graph of the bending durability of a cable of comparative example and a cable in an embodiment.

As shown in FIG. 5, the vertical axis indicates the ratio of the number of broken conductor wires to the one in the comparison example (braking ratio). Therefore, the braking ratio of the comparative example is 1. In this test, the braking ratio of Embodiment 1 was 0.02 and Embodiment 2 was 0.047. As can be known from this, the number of breaks of conductor wires largely differs between the comparative example and Embodiments 1, 2. In the comparative example, the break of conductor wires occurred in large numbers at the specific portion where the stranded conductor in the central part of the cable and stranded conductors arranged on the circumference thereof are in contact. In Embodiments 1 and 2 in contrast, the break of the conductor wire is suppressed, because the pressure that appears on the above-stated specific portion, where the conductor wire break tend to occur most by bending, is relaxed on account of the inclusion 14 and 24, which are more deformable than the stranded conductor, being provided in the central part of the cable. Thus, it was confirmed that the cables 11 and 21 according to embodiments of the present invention were improved largely in bending durability compared to the conventional ones.

The bending stiffness of three cables: Embodiment 1, Embodiment 2, and the comparative example, was measured in terms of the bending radii R. The bending radius R (mm) denotes here a radius of curvature of the portion at which the cable is bent most sharply. The bending radii R were 150, 80, 50, and 30 mm. The bending stiffness ($N \cdot mm^2$) is a value that indicates degree of hardness in bending, which is given by the product of the longitudinal elastic modulus and the second moment of area.

TABLE 1

| | | Bending Radius R (mm) | | | |
|---|---|---|---|---|---|
| | | 150 | 80 | 50 | 30 |
| Normalized Bending Stiffness ($N \cdot mm^2$) | Comparative example | 1 | 1 | 1 | 1 |
| | Embodiment 1 | 0.627 | 0.627 | 0.636 | 0.643 |
| | Embodiment 2 | 0.839 | 0.839 | 0.840 | 0.849 |

As shown in Table 1, the bending stiffness of cables of Embodiment 1 and Embodiment 2 are all less than 1, which is the normalized bending stiffness of the cable of comparative example for each bending radius R. This means that Embodiment 1 and Embodiment 2 have a bending stiffness that is smaller than that of the comparative example. Thus, it was confirmed that the cables 11 and 21 according to embodiments of the present inventions had improved flexibility compared to conventional ones.

From the test results as stated above, it can be concluded that the cables 11 and 21 according to embodiments of the present inventions have adequate bending durability and have enough flexibility for cabling.

Although Embodiment 1 and Embodiment 2 were provided with both the shielding layers 16, 26 and the sheaths 18, 28, even such a cable as has either a shielding layer or a sheath brings the same test results as in Embodiment 1 and Embodiment 2.

It will be obvious to those having skill in the art that many changes may be made in the above-described details of the preferred embodiments of the present invention. The scope of the present invention, therefore, should be determined by the following claims.

The invention claimed is:

1. A cable, comprising:

a cable structure comprising a stranded wire formed by stranding a plurality of stranded conductors;

an inclusion that is more deformable than said stranded conductor, wherein said inclusion has a Shore hardness of 45±5, and wherein said plurality of stranded conductors are annularly arranged so as to cover said inclusion, with said plurality of stranded conductors being spaced apart from each other, when viewed in cross-section; and an insulating layer arranged on the circumference of said stranded conductors, wherein said stranded conductors are in contact with said inclusion and said insulating layer and each have an outer diameter greater than that of said inclusion.

2. The cable according to claim 1, wherein said inclusion is made of resin.

3. The cable according to claim 1, wherein said inclusion is given a tube form.

4. The cable according to claim 1, wherein said inclusion is given a tube form.

5. The cable according to claim 1, wherein said inclusion is a yarn made up of stranded plural fiber threads.

6. The cable according to claim 1, wherein said fiber thread is a staple fiber thread.

7. The cable according to claim 1, wherein a circumference of said insulating layer is covered with a shielding layer composed of a conductive material.

8. The cable according to claim 1, wherein a periphery of said shielding layer is covered with a reinforced braid layer composed of a fiber, and wherein a circumference of said reinforced braid layer is covered with a sheath composed of a resin.

9. A cable, comprising:

a cable structure comprising a master stranded wire formed by stranding a plurality of slave stranded wires each of which is made up of a plurality of stranded conductors;

an inclusion that is more deformable than said slave stranded wire, wherein said inclusion has a Shore hardness of 45±5, and wherein said plurality of slave stranded wires are annularly arranged so as to cover said inclusion, with said plurality of slave stranded wires being spaced apart from each other, when viewed in cross-section; and an insulating layer arranged on the circumference of said slave stranded wires, wherein said slave stranded wires are in contact with said inclusion and said insulating layer and each have an outer diameter greater than that of said inclusion.

10. The cable according to claim 9, wherein said inclusion is made of resin.

11. The cable according to claim 9, wherein said inclusion is given a tube form.

12. The cable according to claim 9, wherein said inclusion is given a tube form.

13. The cable according to claim 9, wherein said inclusion is a yarn made up of stranded plural fiber threads.

14. The cable according to claim 9, wherein said fiber thread is a staple fiber thread.

15. The cable according to claim 9, wherein a circumference of said insulating layer is covered with a shielding layer composed of a conductive material.

16. The cable according to claim 9, wherein a periphery of said shielding layer is covered with a reinforced braid layer composed of a fiber, and wherein a circumference of said reinforced braid layer is covered with a sheath composed of a resin.

* * * * *